US011626086B1

(12) United States Patent
Hei et al.

(10) Patent No.: US 11,626,086 B1
(45) Date of Patent: Apr. 11, 2023

(54) BRIGHTNESS ADJUSTMENT METHOD OF DISPLAY PANEL AND BRIGHTNESS ADJUSTMENT DEVICE OF DISPLAY PANEL

(71) Applicant: Wuhan Tianma Micro-Electronics Co., Ltd., Wuhan (CN)

(72) Inventors: Yajun Hei, Wuhan (CN); Guang Wang, Wuhan (CN); Zhenyuan Zhang, Wuhan (CN); Jingxiong Zhou, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/873,878

(22) Filed: Jul. 26, 2022

(30) Foreign Application Priority Data

Dec. 29, 2021 (CN) ..... 202111642861.6

(51) Int. Cl.
*G09G 5/10* (2006.01)

(52) U.S. Cl.
CPC ..... *G09G 5/10* (2013.01); *G09G 2320/0233* (2013.01); *G09G 2320/0276* (2013.01); *G09G 2320/0626* (2013.01); *G09G 2320/0673* (2013.01)

(58) Field of Classification Search
CPC ..... G09G 5/10; G09G 2320/0233; G09G 2320/0276; G09G 2320/0626; G09G 2320/0673
See application file for complete search history.

(56) References Cited

U.S. PATENT DOCUMENTS

| | | | | |
|---|---|---|---|---|
| 2012/0007894 | A1* | 1/2012 | Shin | G09G 3/3648 345/690 |
| 2018/0374434 | A1* | 12/2018 | Hao | G09G 3/3607 |
| 2019/0287472 | A1* | 9/2019 | Yang | G09G 3/3618 |
| 2020/0160801 | A1* | 5/2020 | Wang | G09G 3/36 |
| 2020/0312256 | A1* | 10/2020 | Lin | G09G 3/3648 |
| 2021/0027730 | A1* | 1/2021 | Kang | G09G 3/3607 |
| 2021/0097948 | A1* | 4/2021 | Kang | G09G 3/3607 |
| 2021/0358443 | A1* | 11/2021 | Chen | G09G 3/3648 |

FOREIGN PATENT DOCUMENTS

| | | | |
|---|---|---|---|
| CN | 107610649 | A | 1/2018 |
| CN | 112562585 | A | 3/2021 |

* cited by examiner

*Primary Examiner* — Antonio Xavier
(74) *Attorney, Agent, or Firm* — Anova Law Group PLLC

(57) ABSTRACT

A method for adjusting brightness of a display panel and a device for adjusting brightness of a display panel are provided. The display panel includes a plurality of sub-pixels, and the method includes adjusting data voltages of at least two sub-pixels of the plurality of sub-pixels to be different when performing a zero grayscale display.

11 Claims, 10 Drawing Sheets

BRIGHTNESS ADJUSTMENT METHOD OF DISPLAY PANEL AND BRIGHTNESS ADJUSTMENT DEVICE OF DISPLAY PANEL

CROSS-REFERENCE TO RELATED APPLICATION

This application claims the priority of Chinese Patent Application No. 202111642861.6, filed on Dec. 29, 2021, the content of which is incorporated by reference in its entirety.

TECHNICAL FIELD

The present disclosure generally relates to the field of display technologies and, more particularly, relates to a method for adjusting brightness of a display panel and a device for adjusting brightness of a display panel.

BACKGROUND

With the continuous development of science and technology, various display devices have been widely used and brought great convenience to users.

A display panel is one of the important components of a display device, and the display control logic of the display panel will directly or indirectly affect the display effect of the display device.

Based on the current display panel, when determining the voltage at zero grayscale display, the conventional technical approaches is to actually measure the voltages of a batch of display panels when displaying the preset brightness, and then obtain multiple voltage values, and select the maximum voltage value from the multiple voltage values. The maximum voltage value plus a voltage buffer value is to obtain the final zero grayscale display voltage, and the final zero grayscale display voltage is used for all the measured batch of display panels to perform the zero grayscale display, and the final zero grayscale display voltage is used for any sub-pixel of the display panel to perform the zero grayscale display.

However, the voltage value of the zero grayscale voltage obtained based on the above technical means is relatively large, and the difference between the zero grayscale voltage and the 1 grayscale voltage is relatively large. Further, the corresponding voltages of the decimal grayscales between the zero grayscale and the 1 grayscale are obtained by interpolation method according to the voltages of the zero grayscale and the 1 grayscale, then in the process of adjusting the brightness of the display panel, when compensating under the 1 grayscale, the voltage change is relative large, and an obvious color cast problem will occur. The present disclosed brightness adjustment methods of display panels and adjustment devices are direct to solve one or more problems set forth above and other problems in the arts.

SUMMARY

One aspect of the present disclosure provides a method for adjusting brightness of a display panel. The display panel includes a plurality of sub-pixels, and the method includes adjusting data voltages of at least two sub-pixels of the plurality of sub-pixels to be different when performing a zero grayscale display.

Another aspect of the present disclosure provides a device for adjusting brightness of a display panel. The display panel includes a plurality of sub-pixels and the device includes an adjustment module. The adjustment module is configured to adjust data voltages of at least two sub-pixels of the plurality of sub-pixels to be different when performing a zero grayscale display.

Other aspects of the present disclosure can be understood by those skilled in the art in light of the description, the claims, and the drawings of the present disclosure.

BRIEF DESCRIPTION OF THE DRAWINGS

The drawings incorporated in the specification and constituting a part of the specification illustrate the embodiments of the present disclosure, and together with the description are used to explain the principle of the present disclosure.

DETAILED DESCRIPTION

The technical solutions in the embodiments of the present disclosure will be clearly and completely described below with reference to the accompanying drawings in the embodiments of the present disclosure. Obviously, the described embodiments are only a part of the embodiments of the present disclosure, rather than all the embodiments. Based on the embodiments of the present disclosure, all other embodiments obtained by those of ordinary skill in the art without creative efforts shall fall within the protection scope of the present disclosure.

In the technical field of this disclosure, in the production process of active matrix organic light-emitting diodes (AMOLED) display panels or other types of display panels, due to material, process and other reasons, some products may have the phenomenon of uneven screen display brightness, that is, Mura. This kind of uneven brightness spot traces will bring visual discomfort, and products with such traces cannot meet the specifications of end customers, and generally can only be scrapped or downgraded.

The external compensation system for the AMOLED production process is to eliminate the Mura patterns on the display panel with poor Mura through advanced sub-pixel optical imaging technology and software algorithms (i.e., De-Mura, which is equivalent to beautifying the display panel), such that the display quality of the display meets the shipping specifications of the panel factory to improve the yield rate of the mass production of the display screen.

Figure 1:
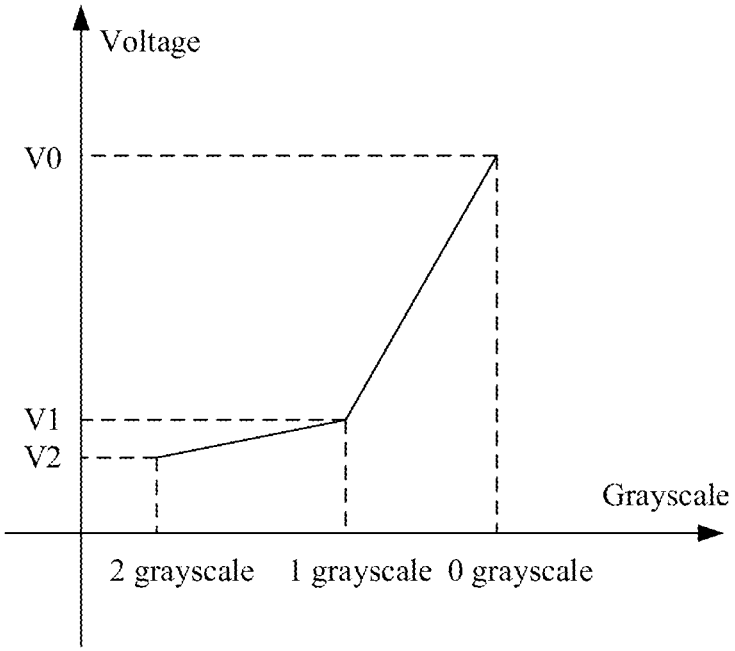
FIG. 1 illustrates a schematic diagram of a gamma curve.

When performing Mura compensation, a gamma curve is usually used as the standard to realize the modulation of the brightness of all levels of grayscales. FIG. 1 is a schematic diagram of a gamma curve. As shown in FIG. 1, the voltages corresponding to zero grayscale is actually measured a batch of display panels when performing the preset brightness (this preset brightness can be the required target brightness for the display panel to perform the zero grayscale display), and then multiple voltage values are obtained. The maximum voltage value is selected from the multiple voltage values, and the maximum voltage value is added with a voltage buffer value to obtain the final voltage corresponding to the zero grayscale. The measured batch of display panels all use the final voltage to perform the zero grayscale, and all sub-pixels in any display panel are driven by the final voltage when the zero grayscale display is performed.

Assuming that the voltages of three display panels for preset brightness display are actually measured, and the voltages are 6.5V, 6.6V and 6.8V. 6.8V is plus with 0.5V and 7.3V is obtained. 7.3 V is used as the final voltage corresponding to the zero grayscale.

However, although the voltage corresponding to the zero grayscale obtained based on the above technical means can ensure that the brightness of the display panel meets the requirements when performing the zero grayscale display, the voltage value is relatively large, and the difference between the voltage value and the voltage corresponding to the 1 grayscale is relatively large; and the effect on the curve shown in FIG. 1, i.e., the slope of curve between the zero grayscale and the 1 grayscale, is relative large.

Further, the voltage corresponding to the fractional grayscales between the zero grayscale and the 1 grayscale is obtained by the interpolation method of the voltage of the zero grayscale and the voltage of the 1 grayscale. Thus, in the process of adjusting the brightness of the display panel, if the grayscale is compensated to below the 1 grayscale, the voltage is significantly changed, and obvious color cast problems occur.

For example, the gamma curve between the zero grayscale and the 1 grayscale is already in an abnormal state. If the low grayscale compensation range of the display panel is still set to be below the 1 grayscale, the display panel will have a serious color cast issue.

Further, for the display panels with the measured voltage values of 6.5V and/or 6.6V, when using 7.3V as the final voltage corresponding to the zero grayscale, based on the rules of display driver integrated circuit, (DDIC), the analog input voltage (analog-VDD, AVDD) of the display panel will be obviously increased, thereby increasing the power consumption of the display panel.

It should be noted that, the AVDD in the embodiment of the present display refers to the analog input voltage of the booster circuit module in the DDIC.

The AVDD voltage is the initial voltage for driving the display panel to work, and the AVDD voltage includes, but is not limited to, various voltages required by the display panel through boosting, bucking, and other operations through some circuit modules inside the display panel.

The present disclosure provides a method for adjusting the brightness of a display panel and a device for adjusting the brightness of the display panel. The method may adjust the data voltages of at least two of the sub-pixels when performing the zero grayscale display to be different. For example, different data voltages may be used for driving different sub-pixels to make the brightness of the sub-pixels reach the target brightness when the sub-pixels perform the zero grayscale display (the target brightness may be the brightness that the display panel needs to meet when the zero grayscale display is performed). Accordingly, the glowing in the zero grayscale display may not occur. Further, for the data voltage with the lowest voltage value, the voltage difference between the data voltage and the data voltage corresponding to the 1 grayscale may be reduced, and the change range of the data voltages corresponding to the decimal grayscales between the zero grayscale and the 1 grayscale may also be reduced. Accordingly, the change of the data voltage when the grayscale of the display panel is compensated to be less than the 1 grayscale during the brightness adjustment process of the display may be relatively small, and the color cast problem may not occur, thereby improving the display uniformity of the display panel.

To make the above objects, features and advantages of the present disclosure more clearly understood, the present disclosure will be described in further detail below with reference to the accompanying drawings and specific embodiments.

Figure 2:
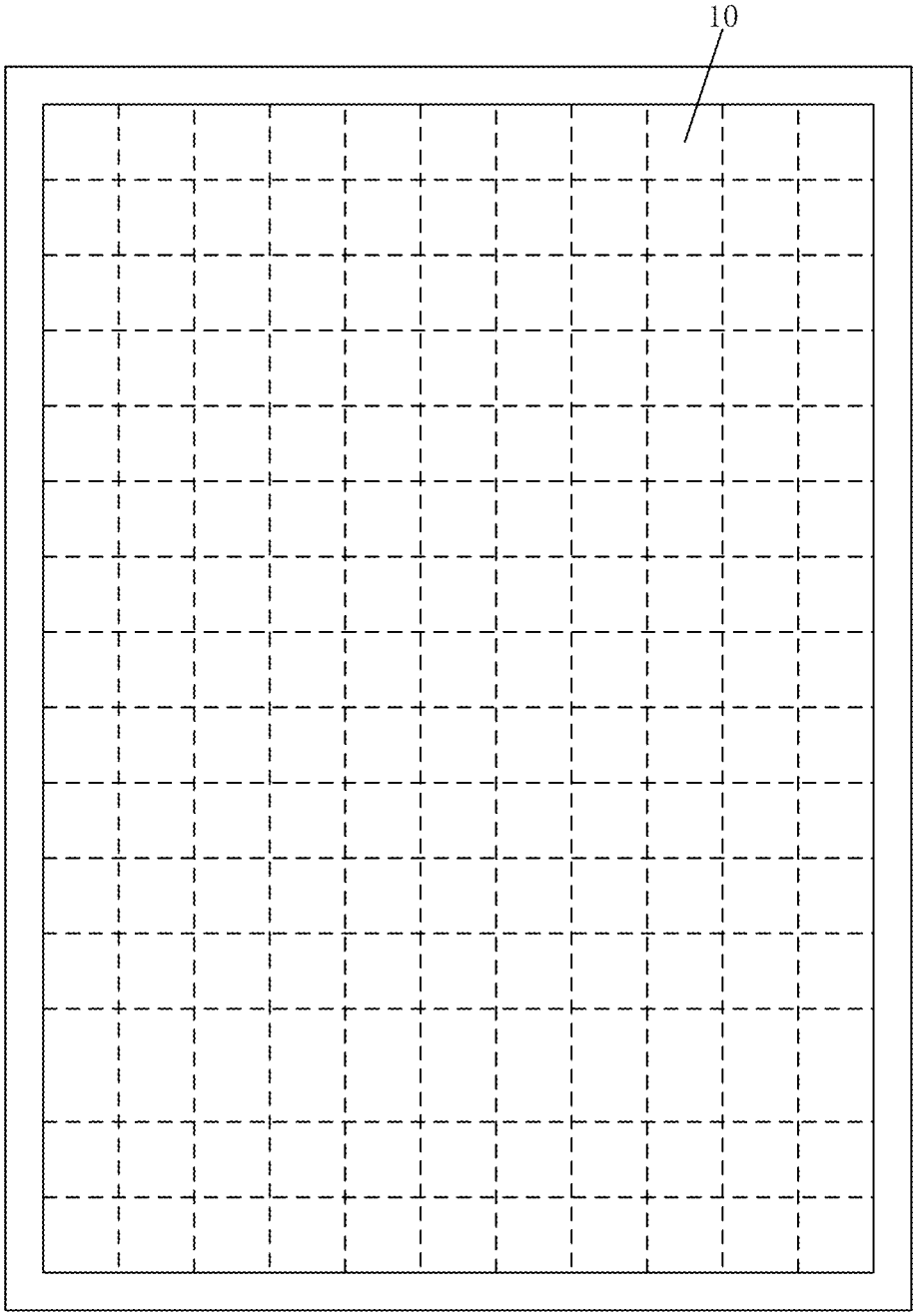
FIG. 2 illustrates a top view of an exemplary display panel according to various disclosed embodiments of the present disclosure.

FIG. 2 is a schematic top view of an exemplary display panel according to various embodiments of the present disclosure. As shown in FIG. 2, the display panel may include a plurality of sub-pixels 10, and each sub-pixel 10 may display according to the received data voltage.

Figure 3:
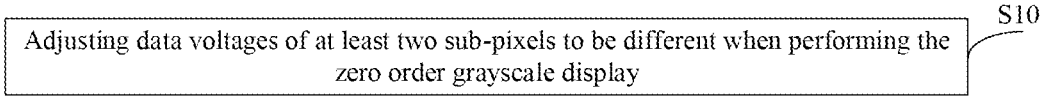
FIG. 3 illustrates a flowchart of an exemplary brightness adjustment method of a display panel according to various disclosed embodiments of the present disclosure.

FIG. 3 is a schematic flowchart of an exemplary method for adjusting brightness of a display panel according to various embodiments of the present disclosure. As shown in FIG. 3, the brightness adjustment method may include:

S10: adjusting at least two sub-pixels of the plurality of sub-pixels to have different data voltages when performing the zero grayscale display.

For example, different data voltages may be used to drive different sub-pixels such that the sub-pixels may achieve the target brightness requirement when performing the zero grayscale display. The target brightness may be the brightness that the display panel may need to meet when performing the zero grayscale display, for example, the glowing issue may not occur when performing the zero grayscale display. The data voltages may include the first data voltage Va1, the second data voltage Va2 and the n-th data voltage Van, and Va1<Va2 . . . <Van.

Figure 4:
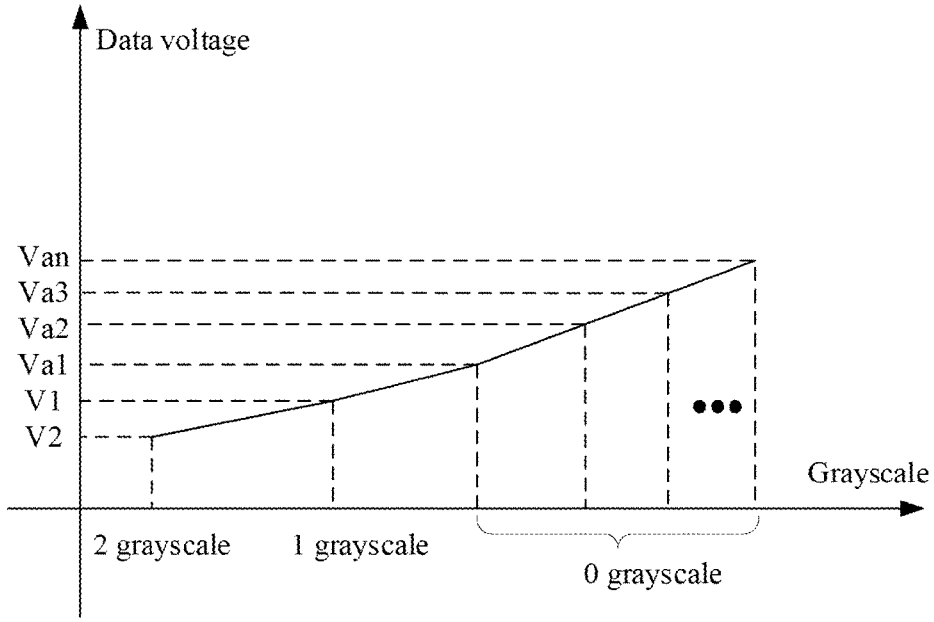
FIG. 4 illustrates an exemplary grayscale-data voltage curve according to various disclosed embodiments of the present disclosure.

FIG. 4 is a schematic diagram of an exemplary grayscale-data voltage curve according to various disclosed embodiments of the present disclosure. For the data voltage with the lowest voltage value, the first data voltage Va1 may reduce by the voltage difference between the first data voltage Va1 and the data voltage corresponding to the 1 grayscale. Accordingly, the variation range of the data voltages corresponding to the fractional grayscales between the zero grayscale and the 1 grayscale may also be reduced, Thus, in the process of the brightness adjustment of the display panel, if the grayscale is compensated to be below the 1 grayscale, the data voltage change may be relatively small; and the color cast issue may not occur, thereby improving the display uniformity of the display panel.

The technology provided by the embodiment of the present disclosure may also be equivalent to expanding the downward compensation range of the low grayscale of the display panel. In the prior art, the compensation can only be down to the 1 grayscale, and the serious color cast will occur when the compensation is further downward. However, in the embodiment of the present disclosure, the compensation may be performed below the 1 grayscale, and the color cast issue may not occur.

Figure 5:
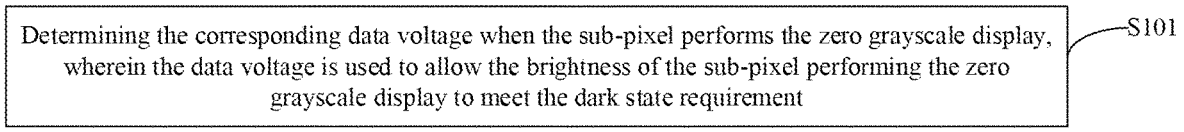
FIG. 5 illustrates a flowchart of another exemplary brightness adjustment method of a display panel according to various disclosed embodiments of the present disclosure.

FIG. 5 is a schematic flowchart of another exemplary method for adjusting brightness of a display panel according to various embodiments of the present disclosure. As shown in FIG. 5, the step S10 "adjusting the data voltages of at least two sub-pixels to be different when performing the zero grayscale display" may include:

S101: determining a corresponding data voltage when a sub-pixel of the at least two sub-pixels performs the 0 gray-scale display. The data voltage may be configured to allow the brightness of the sub-pixel to meet dark state requirements when the sub-pixel performs the zero grayscale display.

Because the data voltages of the sub-pixels may be different when performing the zero grayscale display, and there may be multiple sub-pixels in the display panel, the corresponding data voltage may need to be determined before each sub-pixel performs the zero grayscale display. For example, the first data voltage Va1 may be used for driving the zero grayscale display, or the second data voltage Va2 may be used for driving the zero grayscale display, or the n-th data voltage Van may be used for driving the zero grayscale display, and the brightness of the sub-pixel in the zero grayscale display may need to meet the dark state requirements when the determined data voltage is used for driving. For example, it may be necessary to ensure that the sub-pixel may not glow when the zero grayscale display is performed.

In one embodiment, the brightness that meets the dark state requirements during the zero grayscale display may be less than or equal to 0.001 nit.

It should be noted that, based on the actual application requirements of the display panel or the manufacturer's requirements, the brightness that meets the dark state requirements during the zero grayscale display may be determined based on the actual situation, may not all required to be less than or equal to 0.001 nit. In one embodiment, the requirement that the brightness that meets the dark state requirement during the zero grayscale display is less than or equal to 0.001 nit may be to meet the display brightness requirement of most display panels during the zero grayscale display.

Figure 6:
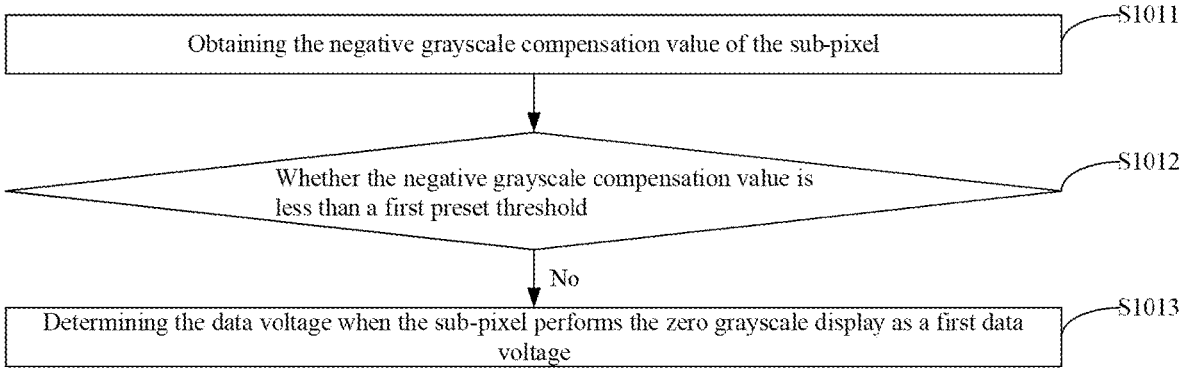
FIG. 6 illustrates a flowchart of another exemplary brightness adjustment method of a display panel according to various disclosed embodiments of the present disclosure.

FIG. 6 is a schematic flowchart of another exemplary method for adjusting the brightness of a display panel according to various embodiments of the present disclosure, as shown in FIG. 6, the step S101 "determining the corresponding data voltage when the sub-pixel performs the zero grayscale display, the data voltage may be used to allow the brightness of the sub-pixel performing the 0 gray-scale display to meet the dark state requirements" may include:

S1011: acquiring a negative grayscale compensation value of the sub-pixel;

S1012: determining whether the negative grayscale compensation value is smaller than a first preset threshold; and

S1013: if the negative gray scale compensation value is not smaller than the first preset threshold, determining the data voltage when the sub-pixel performs the zero grayscale display as the first data voltage.

The negative grayscale compensation value may refer to that, when the sub-pixel performs the preset grayscale display and when its actual brightness is greater than the target brightness corresponding to the preset grayscale, and the preset grayscale may need to be adjusted to a lower grayscale. If the grayscale needs to be adjusted three order lower, the negative grayscale compensation value may be −3. When the sub-pixel needs to be operated at the preset grayscale, the sub-pixel may need to display with the data voltage corresponding to the lower grayscale to make the actual brightness of the sub-pixel equal to the target brightness corresponding to the preset grayscale.

Corresponding to the negative grayscale compensation value, the positive grayscale compensation value may mean that, when the sub-pixel displays the preset grayscale, and its actual brightness is lower than the target brightness corresponding to the preset grayscale, the preset grayscale may need to be adjusted to a higher grayscale. If the grayscale needs to be increased three orders, the positive grayscale compensation value may be +3. When the sub-pixel needs to be operated at the preset grayscale, the sub-pixel may need to be operated with a data voltage corresponding to the higher grayscale such that the actual brightness of the sub-pixel may be equal to the target brightness corresponding to the preset grayscale.

However, in one embodiment of the present disclosure, it may be required that the brightness of the sub-pixels when performing the 0 gray-scale display may need to meet the dark state requirements. For example, the sub-pixels may not be illuminated in the dark state when performing the zero grayscale display. Accordingly, only the negative grayscale compensation value of the sub-pixel may need to be considered, and the positive grayscale compensation value of the sub-pixel may not need to be considered.

The smaller the negative gray-scale compensation value, the more serious the sub-pixel glowing is, and it may need to be adjusted to a lower grayscale. Thus, the value of the required data voltage when the brightness of the sub-pixel meets the dark state requirements during performing the 0 gray-scale display may be larger. For example, the data voltage corresponding to the negative gray scale compensation value of −6 may be smaller than the data voltage corresponding to the negative grayscale compensation value of −9.

In one embodiment, based on the acquired negative grayscale compensation value of the sub-pixel, when the sub-pixel performs the zero grayscale display, whether the negative grayscale compensation value of the sub-pixel is smaller than the first preset threshold may be determined. For example, whether the negative grayscale compensation value of the sub-pixel is less than −6 may be determined. If the negative grayscale compensation value of the sub-pixel is greater than or equal to −6, the first data voltage Va1 may be used as the data voltage of the sub-pixel for performing the 0 gray scale, and under the action of the first data voltage Va1, the brightness when the sub-pixel performs the zero grayscale display may satisfy the dark state requirements.

That is to say, all sub-pixels whose negative grayscale compensation values are greater than or equal to −6 may use the first data voltage Va1 as the data voltage when the sub-pixels perform the zero grayscale display, and the brightness when the sub-pixels perform the zero grayscale display may meet the dark state requirements.

At this time, the first data voltage Va1 may be the minimum data voltage when the sub-pixel performs the zero grayscale display, and the brightness may meet the dark state requirements.

It should be noted that the first preset threshold may be determined based on the actual situation. In one embodiment of the present disclosure, −6 is only used as an example for description. If a smaller first data voltage Va1 is desired, the first preset threshold value may be increased, for example, the first preset threshold value may be set to −3, and under such a configuration, the voltage difference between the first data voltage Va1 and the data voltage corresponding to the 1 grayscale may be smaller. The change range of the data voltages corresponding to the decimal grayscales between the zero grayscale and the 1 grayscale may also become smaller to solve the color cast problem when the grayscale is compensated below the 1 grayscale during the brightness adjustment process of the display panel to the greatest extent, and the display uniformity of the display panel may be improved.

Figure 7:
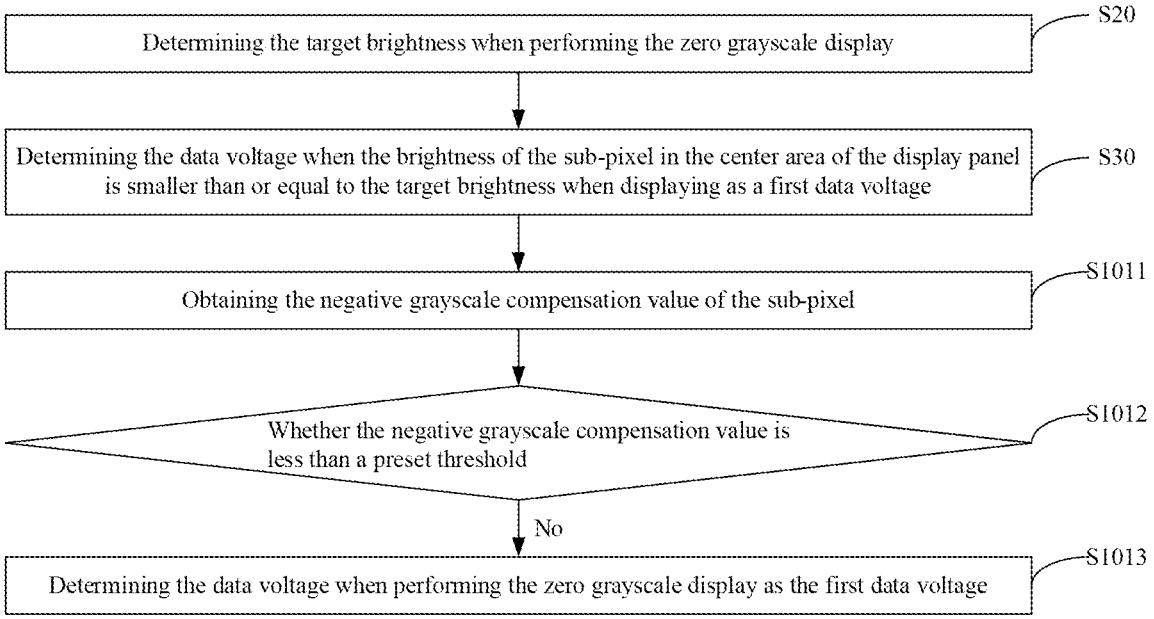
FIG. 7 illustrates a flowchart of another exemplary brightness adjustment method of a display panel according to various disclosed embodiments of the present disclosure.

FIG. 7 is a schematic flowchart of another exemplary method for adjusting the brightness of a display panel according to various embodiments of the present disclosure. As shown in FIG. 7, the brightness adjustment method may further include:

S20: determining the target brightness when performing the zero grayscale display; and S30: determining the data voltage when the brightness of the sub-pixel located in the central area of the display panel is less than or equal to the target brightness during displaying as the first data voltage.

The target brightness of the display panel during the zero grayscale display may be firstly determined. The target brightness may indicate that the brightness during the zero grayscale display may meet the dark state requirement, for example, the target brightness may be less than or equal to 0.001 nit.

Applying a data voltage to the sub-pixel in the central area of the display panel to make them be turned on may include but not limited to detect the actual brightness of the sub-pixel in the central area of the display panel through a test probe. The data voltage applied to the sub-pixel may be adjusted based on the collected actual brightness such that the actual brightness may be less than or equal to the data voltage under the target brightness; and the data voltage may be determined as the first data voltage Va1 in one embodiment of the present disclosure.

First of all, the central area of the display panel may be used as the main display area of the display panel, and the display quality of the central area may be relatively more important than the display quality of the edge area. Secondly, the display quality inspection of the display panel by the display panel manufacturer may be performed on the central area of the display panel. Therefore, in one embodiment of the present application, the brightness of the sub-pixel located in the central area of the display panel may be detected by considering various aspects to determine the first data voltage Va1. The size of the central area may be determined based on the range that can be collected by the test probe, which is not limited in this embodiment of the present disclosure.

It can be seen that the first data voltage Va1 may be smaller than the voltage corresponding to the zero grayscale in the prior art, and the first data voltage Va1 may be the minimum data voltage when the sub-pixel performs the zero grayscale display and the brightness may meet the dark state requirement. For example, the voltage difference between the first data voltage Va1 and the data voltage corresponding to the 1 grayscale may be reduced; and the variation range of the data voltage corresponding to the decimal grayscale between the zero grayscale and the 1 grayscale may also be decreased. Accordingly, in the process of adjusting the brightness of the display panel, if the grayscale is compensated to be below the 1 grayscale, the change of the data voltage may be relatively small, and the color cast problem may not occur, thereby improving the display uniformity of the display panel.

Figure 8:
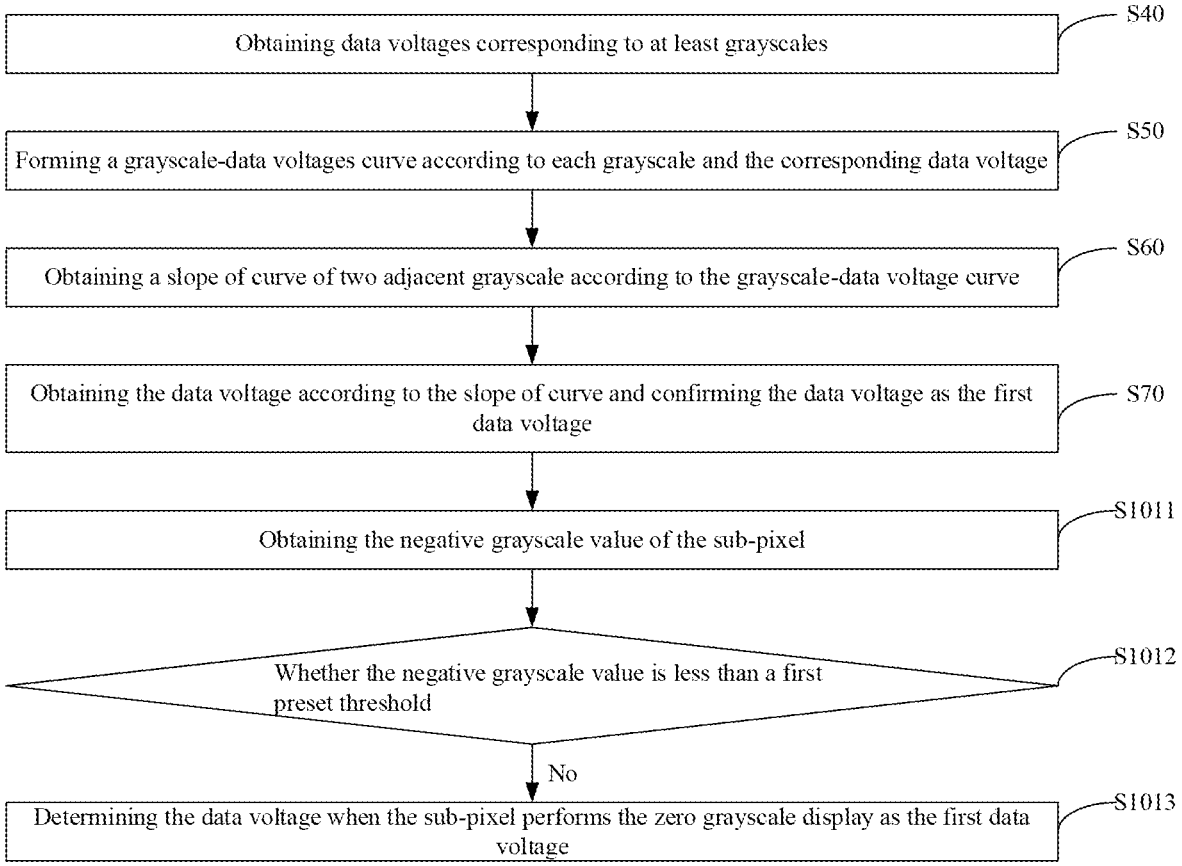
FIG. 8 illustrates a flowchart of another exemplary brightness adjustment method of a display panel according to various disclosed embodiments of the present disclosure.

FIG. 8 is a schematic flowchart of another exemplary method for adjusting brightness of a display panel according to various disclosed embodiments of the present disclosure. As shown in FIG. 8, the adjustment method may also include:

S40: acquiring data voltages corresponding to at least two grayscales;

S50: establishing a grayscale-data voltage curve according to each of the grayscales and the corresponding data voltage;

S60: obtaining a slope of curve between two adjacent grayscales based on the grayscale-data voltage curve; and S70: obtaining a data voltage corresponding to the zero grayscale by extending the slope of curve, and determining the data voltage as the first data voltage.

Figure 9:
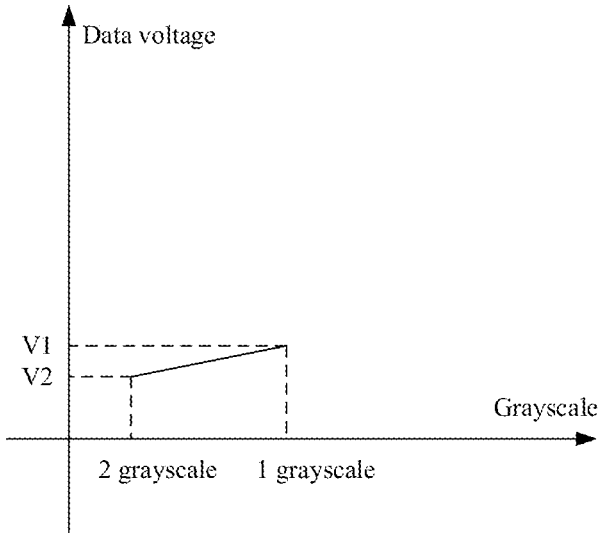
FIG. 9 illustrates another exemplary of grayscale-data voltage curve according to various disclosed embodiments of the present disclosure.

FIG. 9 is a schematic diagram of another exemplary grayscale-data voltage curve according to various disclosed embodiments of the present disclosure. For example, the data voltage corresponding to the 1 grayscale and the data voltage corresponding to the 2 grayscale may be obtained, and the grayscale-data voltage curve may be formed based on the data voltage corresponding to the 1 order grayscale and the data voltage corresponding to the 2 grayscale. Then, the slopes of the curves corresponding to the 1 grayscale and the 2 grayscale may be determined, and extended to the zero grayscale to obtain the data voltage corresponding to the zero grayscale. Such a data voltage may be determined as the first data voltage Va1.

Figure 10:
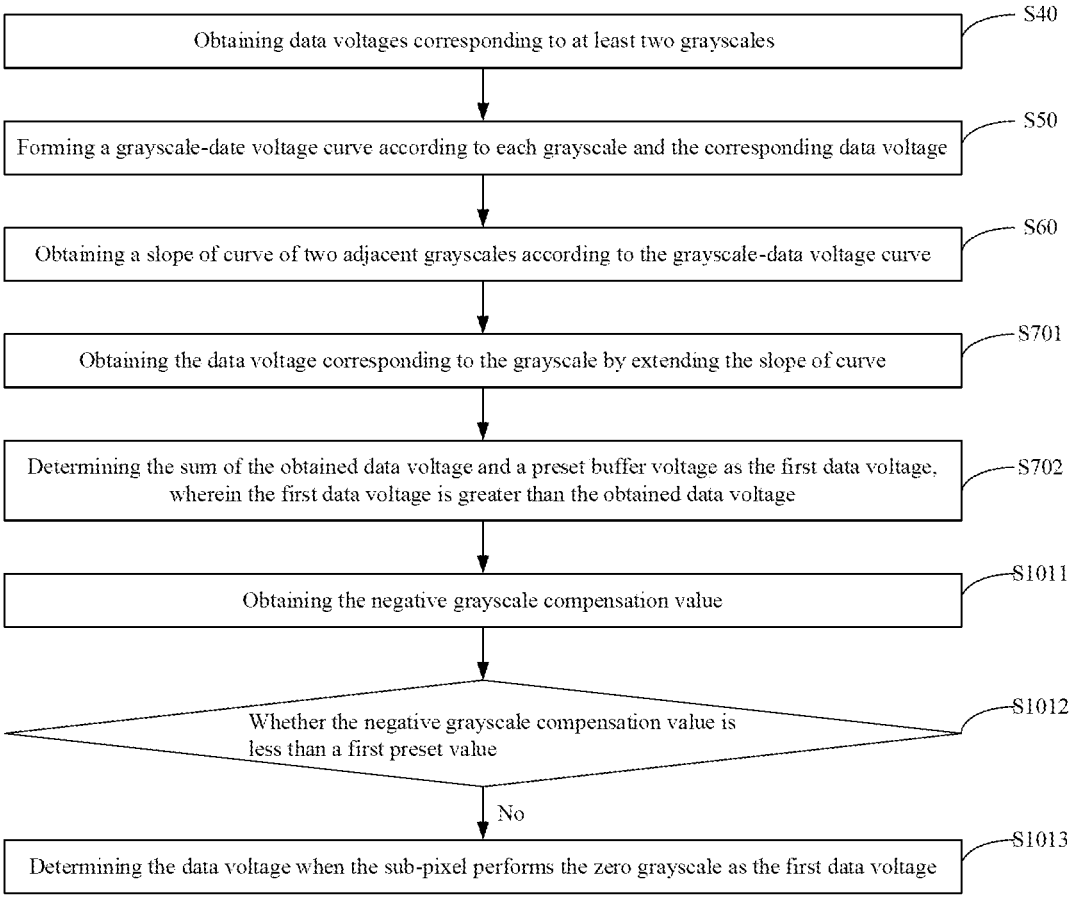
FIG. 10 illustrates a flowchart of another exemplary brightness adjustment method of a display panel according to various disclosed embodiments of the present disclosure.

FIG. 10 is a schematic flowchart of another exemplary method for adjusting the brightness of a display panel according to various disclosed embodiments of the present disclosure, as shown in FIG. 10, the step S70 "obtaining the data voltage corresponding to the zero grayscale according to the slope of curve, and determining the data voltage as the first data voltage" may include:

S701: obtaining a data voltage corresponding to the zero grayscale according to the extension of the slope of curve; and S702: determining the sum of the data voltage and the preset voltage buffer value as the first data voltage, wherein the first data voltage is greater than the obtained data voltage.

Figure 11:
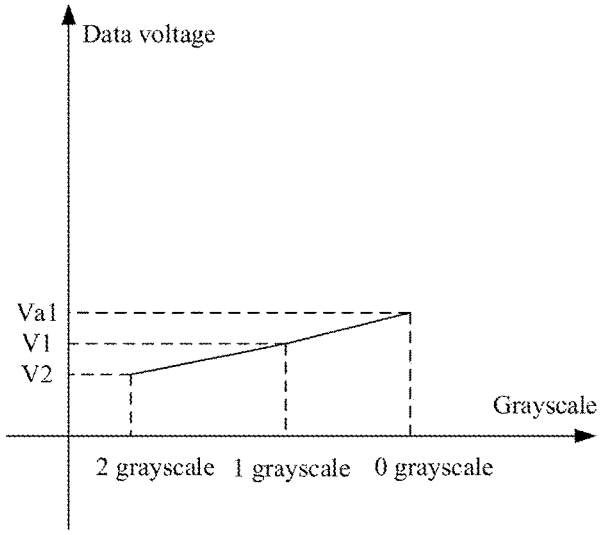
FIG. 11 illustrates another exemplary of grayscale-data voltage curve according to various disclosed embodiments of the present disclosure.

FIG. 11 is a schematic diagram of another exemplary grayscale-data voltage curve according to various disclosed embodiments of the present disclosure. As shown in FIG. 11, to avoid that the brightness of the sub-pixel does not meet the dark state requirement when sub-pixel is driven to perform the zero grayscale display because the data voltage corresponding to the zero grayscale obtained by extending the slope of curve is too small, in one embodiment of the present disclosure, a voltage buffer value may be added to the data voltage corresponding to the zero grayscale obtained based on the extension of slope of curve to obtain the final first data voltage Va1. By obtaining the final first data voltage Va1, which ensures that the brightness of the sub-pixels driven based on the first data voltage Va1 can meet the dark state requirement when performing zero grayscale display, the display effect of the display panel may be improved.

Figure 12:
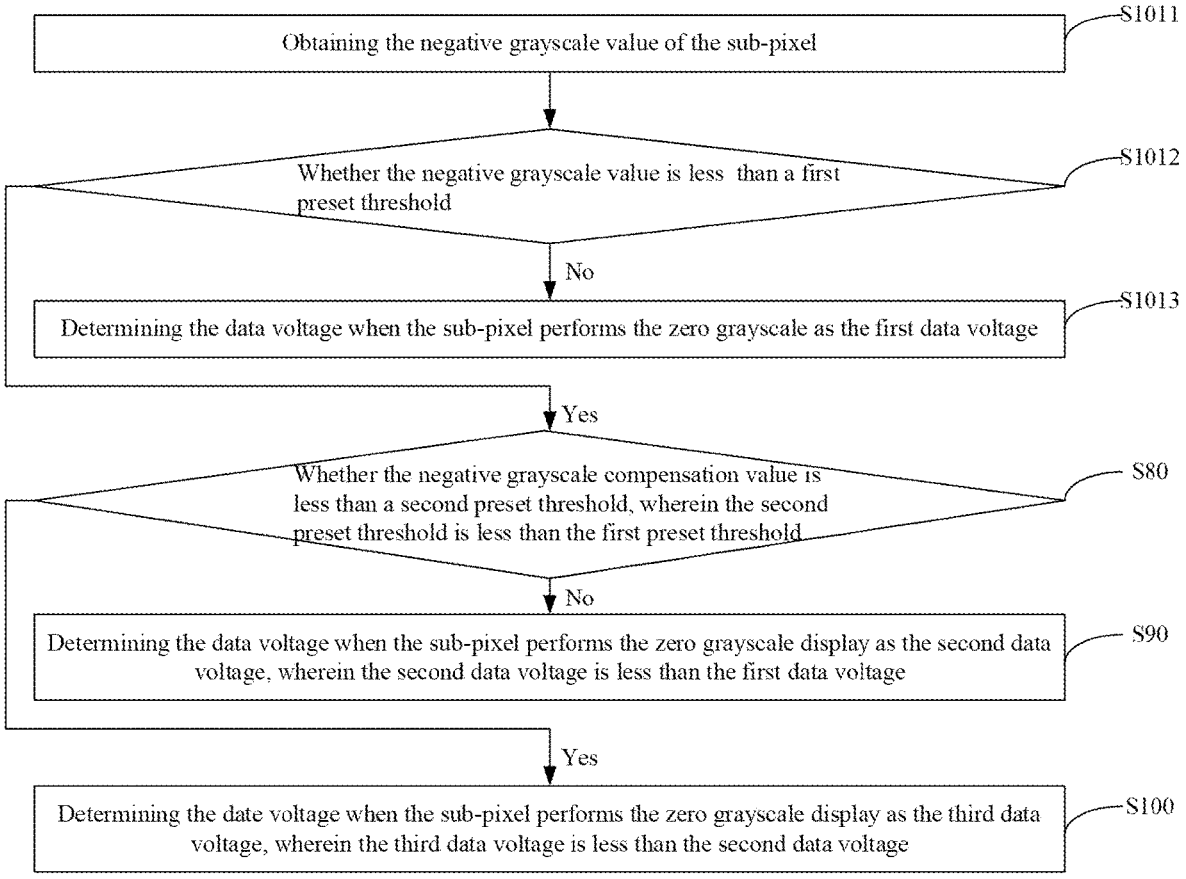
FIG. 12 illustrates a flowchart of another exemplary brightness adjustment method of a display panel according to various disclosed embodiments of the present disclosure.

FIG. 12 is a schematic flowchart of another exemplary method for adjusting the brightness of a display panel according to various disclosed embodiments of the present disclosure. As shown in FIG. 12, when the negative grayscale compensation value is smaller than the first preset threshold, the brightness adjustment method may further include:

S80: determining whether the negative grayscale compensation value is smaller than a second preset threshold, wherein the second preset threshold may be smaller than the first preset threshold;

S90: if the negative grayscale compensation value is not smaller than the second preset threshold, determining that the data voltage when the sub-pixel performs the zero grayscale display as the second data voltage, and the second data voltage may be greater than the first data voltage; and S100: if the negative grayscale compensation value is not smaller than the second preset threshold, determining the data voltage when the sub-pixel performs the zero grayscale display as a third data voltage, and the third data voltage may be greater than the second data voltage.

Based on the acquired negative grayscale compensation value of the sub-pixel, when the sub-pixel performs the zero grayscale display, whether the negative grayscale compensation value of the sub-pixel is smaller than the first preset threshold may be determined, for example, whether the negative grayscale compensation value of the sub-pixel is less than −6 may be determined. If the negative grayscale compensation value of the sub-pixel is less than −6, whether the negative grayscale compensation value of the sub-pixel is smaller than the second set threshold may be further determined. The second preset threshold may be smaller than the first preset threshold. For example, whether the negative gray scale compensation value of the sub-pixel is less than −8 may be further determined. If the negative gray scale compensation value of the sub-pixel is greater than or equal to −8, the second data voltage Va2 may be used as the data voltage when the sub-pixel performs the zero grayscale display, and under the action of the second data voltage Va2, the brightness of the sub-pixel when performing the zero grayscale display may satisfy the dark state requirement.

That is to say, all sub-pixels whose negative grayscale compensation value is greater than or equal to −8 may use the second data voltage Va2 as the data voltage when performing the zero grayscale display, and the brightness when the sub-pixels perform the zero grayscale display may meet the dark state requirements.

However, in the present disclosure, the second data voltage Va2 may be used as the data voltage of all sub-pixels whose negative grayscale compensation values are greater than or equal to −8 and less than −6 when performing the zero grayscale display, and the first data voltage Va1 may be used as the data voltage of all the sub-pixels in the sub-pixels whose grayscale compensation values are greater than or equal to −6 when performing the zero grayscale display. Because the voltage value of the first data voltage Va1 may be smaller than the voltage value of the second data voltage Va2, the data voltages of different voltage values may be used to drive sub-pixels located in different negative grayscale compensation value ranges to perform the zero grayscale display. On the premise that the brightness of sub-pixels when performing the zero grayscale display may meet the dark state requirements, the display power consumption of the display panel may also be saved to achieve the purpose of reducing the power consumption.

If the negative grayscale compensation value of the sub-pixel is less than −8, the third data voltage Va3 may be used as the data voltage when the sub-pixel performs the zero grayscale display. Under the action of the third data voltage Va3, the brightness of the sub-pixel when performing the zero grayscale display may meet the dark state requirements.

In general, all sub-pixels in the display panel may use the third data voltage Va3 as the data voltage when the sub-pixels perform the zero grayscale display, and the brightness of the sub-pixels when performing the zero grayscale display may meet the dark state requirements.

However, in this application, all sub-pixels whose negative grayscale compensation value is less than −8 may use the third data voltage Va3 as the data voltage when the sub-pixel performs the zero grayscale display, and all sub-pixels whose negative gray-scale compensation value is greater than or equal to −8 and less than −6 may use the second data voltage Va2 as the data voltage when the sub-pixel performs the zero grayscale display, and all sub-pixels whose negative gray-scale compensation values are greater than or equal to −6 may use the first data voltage Va1 as the data voltage when the sub-pixel performs the zero grayscale display. Because the voltage value of the first data voltage Va1 may be smaller than the voltage value of the second data voltage Va2 and the voltage value of the third data voltage Va3 may be smaller than the voltage value of the third data voltage Va3, data voltages with different voltage values may be used to drive the sub-pixels with different the negative grayscale compensation value ranges to perform the zero grayscale display. On the premise that the brightness of the sub-pixels when performing the zero grayscale display may meet the dark state requirements, the display power consumption of the display panel may also be saved to achieve the purpose of reducing the power consumption.

It should be noted that the first preset threshold and the second preset threshold may be determined based on actual conditions. In one embodiment of the present disclosure, only the configuration that the first preset threshold is −6 and the second preset threshold is −8 is used as an example. The range of the negative grayscale compensation value less than −8 may be further divided. For example, a third preset threshold and a fourth preset threshold, etc. may be set, whose execution logic may be same as the execution logic of the second preset threshold.

Figure 13:
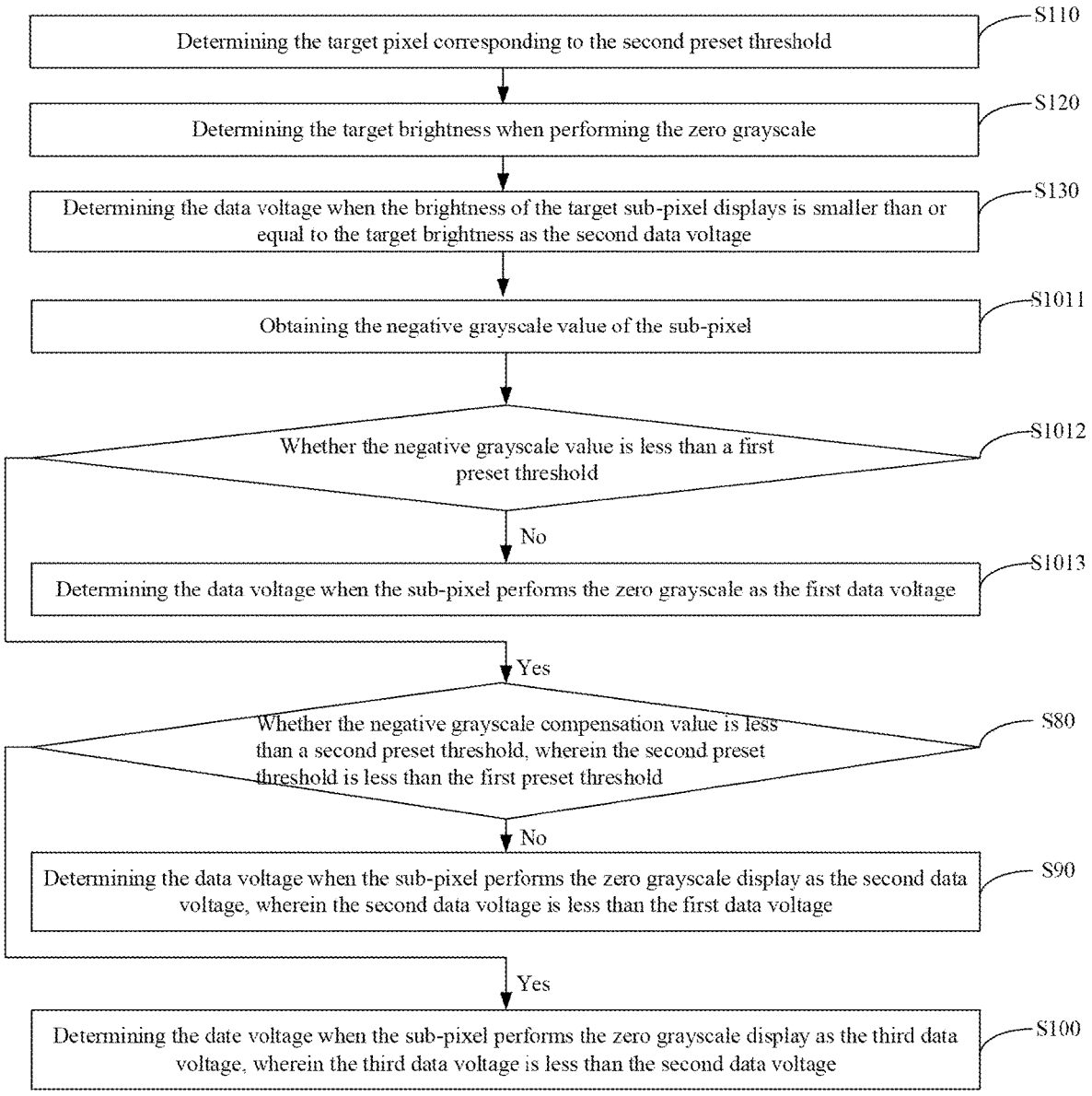
FIG. 13 illustrates a flowchart of another exemplary brightness adjustment method of a display panel according to various disclosed embodiments of the present disclosure.

FIG. 13 is a schematic flowchart of still another exemplary method for adjusting the brightness of a display panel according to various embodiments of the present disclosure. As shown in FIG. 13, in one embodiment, the brightness adjustment method may further include:

S110: determining a target sub-pixel corresponding to the second preset threshold;

S120: determining a target brightness when the zero grayscale is displayed; and

S130: determining a data voltage when the display brightness of the target sub-pixel is less than or equal to the target brightness as the second data voltage.

Specifically, the target brightness of the display panel during the zero grayscale display may be determined firstly. The target brightness may indicate that the brightness during the zero grayscale display may meet the dark state requirement, for example, the target brightness may be less than or equal to 0.001 nit.

Next, the target sub-pixel corresponding to the negative grayscale compensation value of −8 may be determined. For example, the determined negative grayscale compensation value of the target sub-pixel may be −8.

Applying a data voltage to the determined target sub-pixel to make it light up may include, but not limited to, collect the current display image of the display panel through a high-precision image capturing device, and the actual brightness of the target sub-pixel may be determined based on the displayed image, and based on the collected actual brightness, the voltage value of the data voltage applied to the target sub-pixel may be adjusted such that the data voltage when the actual brightness is less than or equal to the target brightness may be used as the to-be-determined second data voltage Va2 in the one embodiment of the present disclosure.

That is to say, all sub-pixels whose negative grayscale compensation value is greater than or equal to −8 and less than −6 may use the second data voltage Va2 as the data voltage when the sub-pixel performs the 0 gray-scale display, and the brightness of the sub-pixel when performing the zero grayscale display may meet the dark state requirement.

Figure 14:
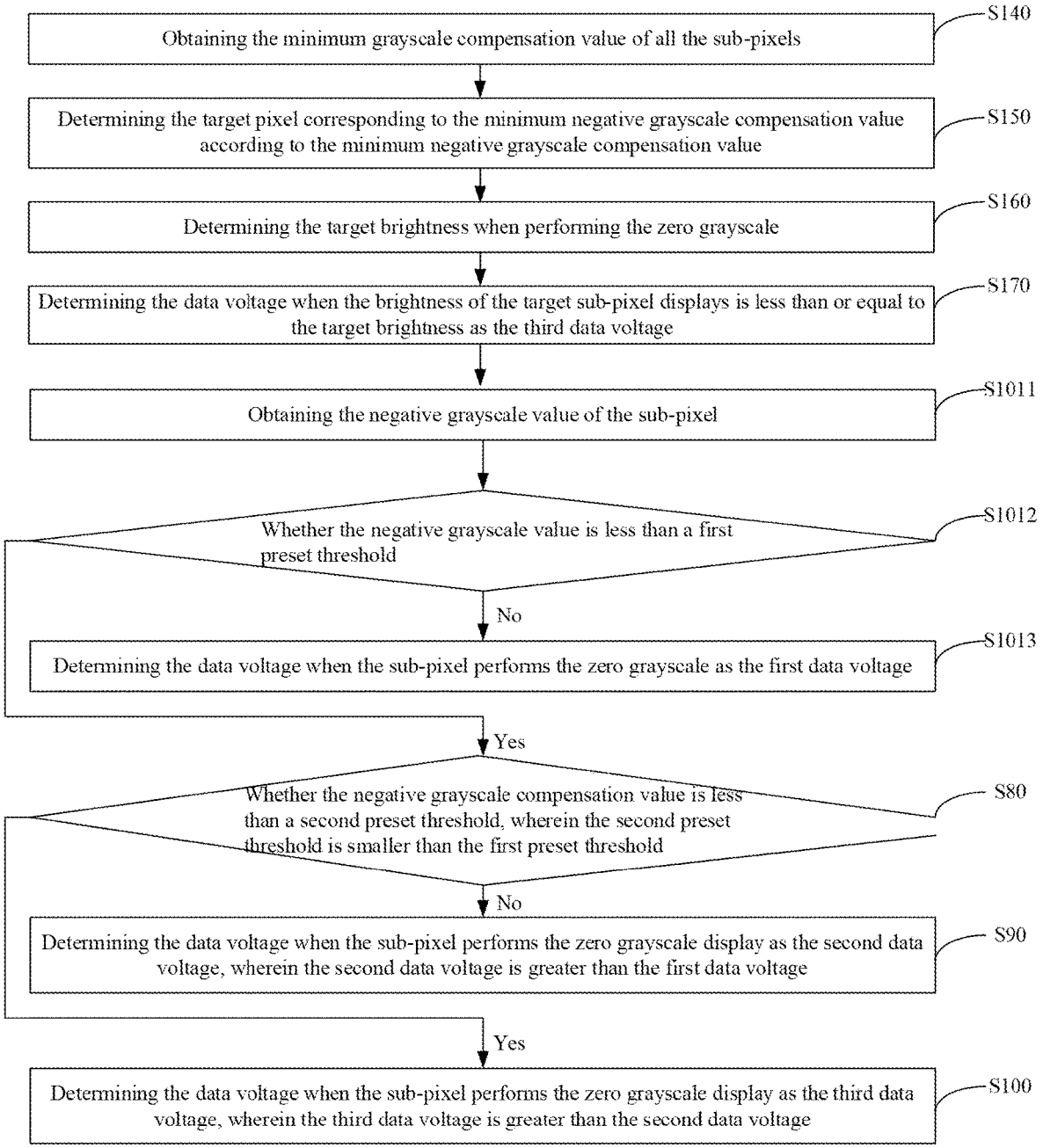
FIG. 14 illustrates a flowchart of another exemplary brightness adjustment method of a display panel according to various disclosed embodiments of the present disclosure.

FIG. 14 is a schematic flowchart of another exemplary method for adjusting the brightness of a display panel according to an embodiment of the present disclosure. As shown in FIG. 14, in one embodiment, the brightness adjustment method may include:

S140: obtaining the minimum negative grayscale compensation value in all the sub-pixels;

S150: based on the minimum negative grayscale compensation value, determining a target sub-pixel corresponding to the minimum negative grayscale compensation value;

S160: determining the target brightness when the zero grayscale is displayed; and

S170: determining a data voltage when the display brightness of the target sub-pixel is less than or equal to the target brightness as the third data voltage.

Because the brightness of the sub-pixel corresponding to the minimum negative grayscale compensation value when performing the zero grayscale display may be a maximum data voltage corresponding to the dark state requirement, to ensure the brightness of all target sub-pixels whose negative grayscale compensation values are less than −8 when performing the zero grayscale display to meet the dark state requirement, the third data voltage Va3 may need to be determined based on the minimum negative grayscale compensation value, the process may be as follows.

First, based on all negative grayscale compensation values of the sub-pixels, the minimum negative grayscale compensation value may be determined, for example, the minimum negative grayscale compensation value may be −10.

Secondly, the target sub-pixel corresponding to the negative grayscale compensation value of −10 may be determined. For example, the negative grayscale compensation value of the determined target sub-pixel may be −10.

Furthermore, the target brightness of the display panel during the zero grayscale display may be determined, and the target brightness may indicate that the brightness when the zero grayscale display is performed may satisfy the dark state requirement. For example, the target brightness may be less than or equal to 0.001 nit.

Applying a data voltage to the determined target sub-pixel to make it light up may include but not limited to collect the current display image of the display panel through a high-precision image capturing device, and determine the actual brightness of the target sub-pixel based on the displayed image, and based on the collected actual brightness, the voltage value of the data voltage applied to the target sub-pixel may be adjusted such that the data voltage when the actual brightness is less than or equal to the target brightness may be determined as the to-be-determined third data voltage Va3 in the embodiment of the present disclosure.

For example, all sub-pixels whose negative grayscale compensation value are less than −8 may use the third data voltage as the data voltage when the sub-pixels perform the zero grayscale display, and the brightness of the sub-pixels when performing the zero grayscale display may satisfy the dark state requirements.

It can be seen that the third data voltage Va3 may be the maximum data voltage when the display panel performs the zero grayscale display, and the brightness of the sub-pixels when performing the zero grayscale display may meet the dark state requirement. That is to say, based on the minimum negative grayscale compensation value in the sub-pixel of each display panel, the corresponding third data voltage Va3 may be different, and based on the DDIC rule, the AVDD voltage corresponding to each display panel may also be different. For example, the third data voltage corresponding to the first display panel may be 6.5V, and the third data voltage corresponding to the second display panel may be 6.8V, then the AVDD corresponding to the first display panel may be AVDD=6.5V+ΔV1, and the AVDD corresponding to the second display panel may be AVDD=6.5V+ΔV1. The specific value of ΔV1 may be determined based on the rules of DDIC, and may be a constant value.

Based on the technical means of the prior art, the third data voltage of the first display panel and the second display panel are both 6.8V plus a voltage buffer value ΔV2 as the final third data voltage, then the AVDD corresponding to the first display panel and the second display panel may be AVDD=6.8+ΔV2+ΔV1.

It may be seen that each display panel may correspond to its own third data voltage and its own AVDD using the technical solutions provided in the embodiments of the present disclosure. Thus, the display power consumption of the display panel may be reduced.

Figure 15:
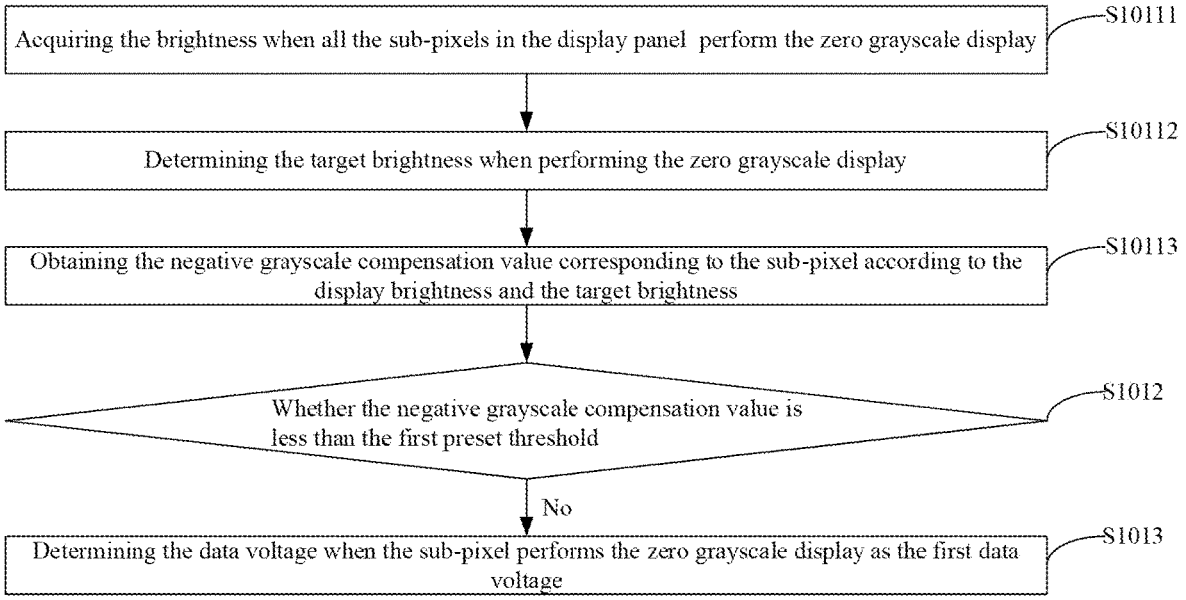
FIG. 15 illustrates a flowchart of another exemplary brightness adjustment method of a display panel according to various disclosed embodiments of the present disclosure.

FIG. 15 is a schematic flowchart of another exemplary method for adjusting the brightness of a display panel according to various embodiments of the present disclosure. As shown in FIG. 15, the step S1011 "obtaining the negative grayscale compensation value of the sub-pixel" may include:

S10111: collecting the display brightness of all sub-pixels in the display panel when performing the zero grayscale display;

S10112: determining the target brightness when the zero grayscale is displayed; and S10113: acquiring a negative grayscale compensation value corresponding to the sub-pixel according to the display brightness and the target brightness.

Specifically, the target brightness of the display panel during the zero grayscale display may be determined, and the target brightness may indicate that the brightness when performing the zero grayscale display may satisfy the dark state requirement, for example, the target brightness may be less than or equal to 0.001 nit.

Apply a data voltage to all sub-pixels in the display panel to display the zero grayscale may include but not limited to collect the current display image of the display panel through a high-precision image capture device, and determine the display brightness of all sub-pixels based on the display image. In one embodiment of the present disclosure, only the problem of the zero grayscale displaying dark glowing state is considered, thus it may be only necessary to determine the sub-pixels whose display brightness is greater than the target brightness, and determine the corresponding negative grayscale compensation value based on the display brightness of each sub-pixel combined with the target brightness.

Figure 16:
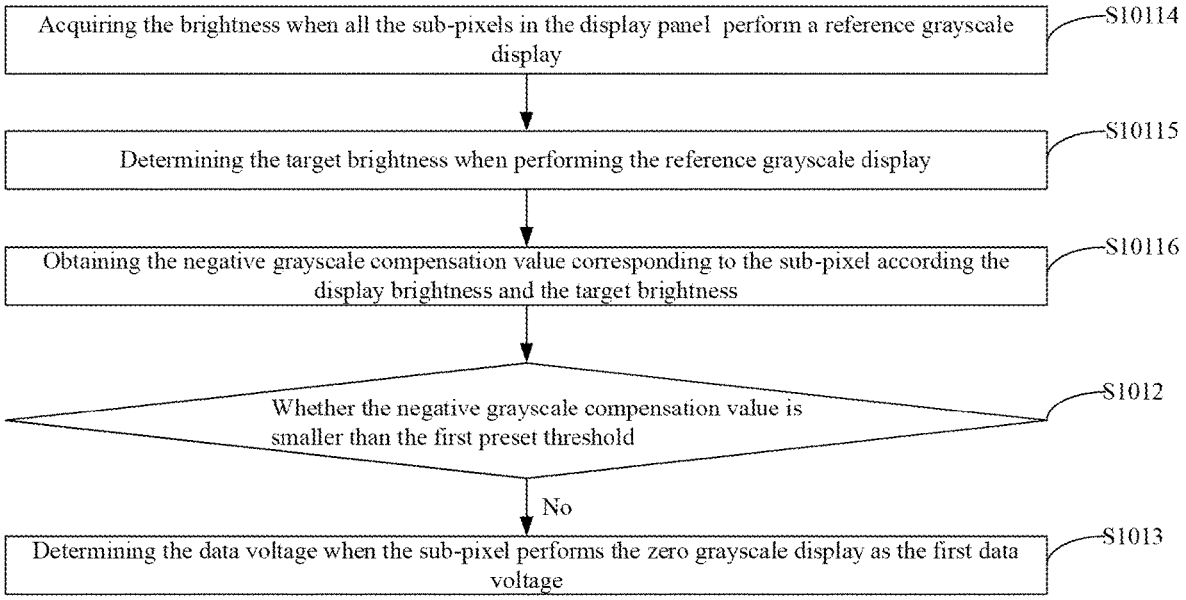
FIG. 16 illustrates a flowchart of another exemplary brightness adjustment method of a display panel according to various disclosed embodiments of the present disclosure.

FIG. 16 is a schematic flowchart of another exemplary method for adjusting the brightness of a display panel according to various embodiments of the present disclosure. As shown in FIG. 16, in one embodiment of the present disclosure, the step S1011 "obtaining the negative grayscale compensation value of the sub-pixel" may include:

S10114: collecting the display brightness of all the sub-pixels in the display panel when performing a reference grayscale display;

S10115: determining the target brightness when the reference grayscale is displayed; and S10116: acquiring a negative grayscale compensation value corresponding to the sub-pixel according to the display brightness and the target brightness.

Specifically, the reference grayscale may be 16 grayscales, 32 grayscales, or 128 grayscales. The reference grayscale may be the grayscale under which the sub-pixel glows under the dark state. Thus, such sub-pixel may also be glowing at the dark state. Accordingly, the grayscale compensation value of the sub-pixel may be determined based on the reference gray-scale.

Applying a data voltage to all sub-pixels in the display panel to perform the reference grayscale display may include but not limited to collect the current display image of the display panel through a high-precision image capture device, and determine the display brightness of all sub-pixels based on the display image. Because the embodiment of the present disclosure may only consider the problem of the dark state glowing performing the zero grayscale displaying. Thus, it may be only necessary to determine the sub-pixels whose display brightness is greater than the target brightness, and the corresponding negative grayscale compensation value may be determined based on the display brightness of each sub-pixel combined with the target brightness.

Figure 17:
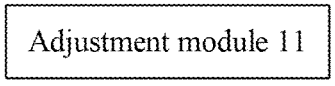
FIG. 17 illustrates the principle structure of an exemplary brightness adjustment device of a display panel according to various disclosed embodiments of the present disclosure.

The present disclosure further provides a brightness adjustment device of a display panel. FIG. 17 illustrates a schematic principle structure of an exemplary brightness adjustment device according to various embodiments of the present disclosure. of the brightness adjustment device.

As shown in FIG. 17, the display panel may include a plurality of sub-pixels, and the brightness adjustment device may include an adjustment module 11. The adjustment module 11 may be configured to adjust the data voltages of at least two sub-pixels of the plurality of sub-pixels to be different when performing the zero grayscale display. The adjustment module may be a combination of software and hardware.

Figure 18:
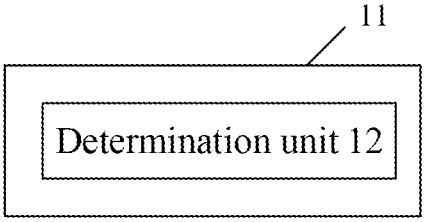
FIG. 18 illustrates the principle structure of another exemplary brightness adjustment device of a display panel according to various disclosed embodiments of the present disclosure.

FIG. 18 is a schematic principle structure of another exemplary device for adjusting the brightness of a display panel according to various embodiments of the present disclosure.

As shown in FIG. 18, the display panel may include an adjustment module 11. The adjustment module 11 may include a determination unit 12. The determination unit 12 may be configured to determine a corresponding data voltage when the sub-pixel performs the 0 gray-scale display, and the data voltage may be configured to allow the brightness of the sub-pixel to meet the dark state requirement when performing the zero grayscale display.

Figure 19:
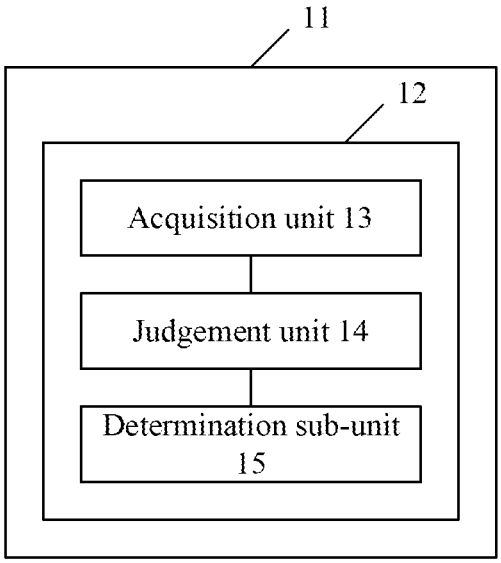
FIG. 19 illustrates the principle structure of another exemplary brightness adjustment device of a display panel according to various disclosed embodiments of the present disclosure.

FIG. 19 is a schematic diagram of the principle structure of another device for adjusting the brightness of a display panel according to various embodiments of the present disclosure. As shown in FIG. 19, in one embodiment, the determination unit 12 may include acquisition sub-unit 13. The acquisition sub-unit 13 may be configured to acquire the negative grayscale compensation value of the sub-pixel.

The determine unit 12 may also include a judgement sub-unit 14. The judgement sub-unit 14 may be configured to judge whether the negative grayscale compensation value is less than a first preset threshold.

The determination unit 12 may also include a determination sub-unit 15. The determination sub-unit 15 may be configured to determine that the data voltage when the sub-pixel unit performs the zero grayscale display as the first data voltage when the negative grayscale compensation value is greater than or equal to the first preset threshold.

It should be noted that, for the refined functions of each module or each unit or each sub-unit in the embodiments of the present disclosure, reference may be made to the disclosure section corresponding to the above-mentioned embodiment of the brightness adjustment method, and details are not described herein again.

A method for adjusting brightness of a display panel and a device for adjusting brightness of the display panel provided by the present disclosure have been described above in detail. In the present disclosure, specific examples are used to illustrate the principles and implementations. The descriptions of the above embodiments are only used to help to understand the method of the present disclosure and its core idea. At the same time, for those skilled in the art, according to the idea of the present disclosure, there will be changes in the specific implementation and application scope. In summary, the content of this specification should not be understood as a limitation of the present disclosure.

It should be noted that the various embodiments in this specification are described in a progressive manner, and each embodiment focuses on the differences from other embodiments. For the same and similar parts among the various embodiments, references may be made to each other. As for the device disclosed in the embodiment, because it may correspond to the method disclosed in the embodiment, the description is relatively simple, and the relevant part may be referred to the description of the method.

It should also be noted that in this document, relational terms such as first and second are used only to distinguish one entity or operation from another, and do not necessarily require or imply those entities or operations to have such actual relationship or order between them. Furthermore, the terms "comprising", "comprising" or any other variation thereof are intended to encompass a non-exclusive inclusion such that a process, method, article, or device of a list of elements is included, inherent to, or is also included for, those processes. Without further limitation, an element qualified by the phrase "comprising a . . . " does not preclude the presence of additional identical elements in a process, method, article or apparatus that includes the element.

The above description of the disclosed embodiments enables any person skilled in the art to make or use the present disclosure. Various modifications to these embodiments will be readily apparent to those skilled in the art, and the generic principles defined herein may be implemented in other embodiments without departing from the spirit or scope of the disclosure. Thus, the present disclosure is not intended to be limited to the embodiments shown herein, but is to be accorded the widest scope consistent with the principles and novel features disclosed herein.

What is claimed is:

1. A method for adjusting a brightness of a display panel, the display panel including a plurality of sub-pixels, comprising:

adjusting data voltages of at least two sub-pixels of the plurality of sub-pixels to be different when performing zero grayscale display, which includes:

determining a data voltage corresponding to a sub-pixel of the at least two sub-pixels when performing the zero grayscale display, wherein the data voltage is configured to allow a brightness of the sub-pixel to meet dark state requirements when performing the zero grayscale display, wherein determining the data voltage includes:

obtaining a negative grayscale compensation value of the sub-pixel;

determining whether the negative grayscale compensation value is less than a first preset threshold; and determining a data voltage when the sub-pixel performs the zero grayscale display as a first data voltage if the negative grayscale compensation value is not less than the first preset threshold.

2. The method according to claim 1, further comprising:

determining a target brightness when performing the zero grayscale display; and determining a data voltage when a display brightness of a sub-pixel located in a center area of the display panel is smaller than or equal to the first preset threshold as the first data voltage when the sub-pixel displays.

3. The method according to claim 1, further comprising:

obtaining data voltages corresponding to at least two grayscales;

forming a grayscale-data voltage curve according to each grayscale and a corresponding data voltage;

obtaining a slope of curve of the two adjacent grayscales according to the grayscale-data voltage curve; and obtaining a data voltage corresponding to the zero grayscale by extending the slope of curve and determining the obtained data voltage as the first data voltage.

4. The method according to claim 3, wherein obtaining the data voltage corresponding to the zero grayscale by extending the slope of curve and determining the data voltage as the first data voltage comprises:

obtaining the data voltage corresponding to the zero grayscale by extending the slope of curve; and determining a sum of the obtained data voltage and a preset voltage buffer value as the first data voltage, wherein the first data voltage is greater than the obtained data voltage.

5. The data voltage according to claim 1, wherein when the negative grayscale compensation value is less than the first preset threshold, further comprising:

determining whether the negative grayscale compensation value is less than a second preset threshold that is less than the first preset threshold;

determining a data voltage when the sub-pixel performs the zero grayscale display as a second data voltage that is greater than the first data voltage when the negative grayscale compensation value is not smaller than the second preset threshold; and determining a data voltage when the sub-pixel performs the zero grayscale display as a third data voltage that is greater than the second data voltage when the negative grayscale compensation value is smaller than the second preset threshold.

6. The method according to claim 5, further comprising:

determining a target pixel corresponding to the second preset threshold;

determining a target brightness when performing the zero grayscale display; and determining a data voltage when a brightness of the target pixel when displaying is smaller than or equal to the target brightness as the second data voltage.

7. The method according to claim 5, further comprising:

obtaining a minimum negative grayscale compensation value of all the plurality of sub-pixels;

determine a target sub-pixel corresponding the minimum negative grayscale compensation value according to the minimum negative grayscale compensation value;

determining a target brightness when performing the zero grayscale; and determining a data voltage when a brightness of the target pixel when displaying is smaller than or equal to the target brightness as the third data voltage.

8. The method according to claim 1, wherein obtaining the negative grayscale compensation value comprises:

acquiring display brightness of all the plurality of sub-pixels in the display panel when performing the zero grayscale display;

determining a target brightness when performing the zero grayscale display; and obtaining a negative grayscale compensation value corresponding to the sub-pixel according to the display brightness and the target brightness.

9. The method according to claim 1, wherein obtaining the negative grayscale compensation value comprises:

acquiring display brightness of all the plurality of sub-pixels in the display panel when performing a reference grayscale display;

determining a target brightness when performing the reference grayscale display; and obtaining a negative grayscale compensation value corresponding to the sub-pixel according to the display brightness and the target brightness.

10. The method according to claim 1, wherein:

a brightness that meets the dark state requirements when performing the zero grayscale is smaller than or equal to 0.001 nit.

11. A device for adjusting a brightness of a display panel, the display panel including a plurality of sub-pixels, comprising:

an adjustment circuit, configured to adjust data voltages of at least two sub-pixels of the plurality of sub-pixels to be different when performing zero grayscale display, wherein the adjustment circuit comprises: a determination circuit, configured to determine a corresponding data voltage when a sub-pixel of the at least two sub-pixels performs the zero grayscale display, wherein the data voltage is configured allow a brightness of the sub-pixel to meet dark state requirements when performing the zero grayscale display, the determination circuit comprising:

an acquisition circuit, configured to obtain a negative grayscale compensation value of the sub-pixel;

a judgement circuit, configured to judge whether the negative grayscale compensation value is smaller than a first preset threshold; and a determination sub-circuit, configured to determine a data voltage when the sub-pixel performs the zero grayscale as a first data voltage when the negative grayscale compensation value is greater than or equal to the first preset threshold.

* * * * *